US007427375B1

(12) United States Patent
Cushman

(10) Patent No.: US 7,427,375 B1
(45) Date of Patent: Sep. 23, 2008

(54) DIFFUSER FOR AN ANNEALING FURNACE

(75) Inventor: Floyd Cushman, Rochester, MI (US)

(73) Assignee: MNP Corporation, Utica, MI (US)

( * ) Notice: Subject to any disclaimer, the term of this patent is extended or adjusted under 35 U.S.C. 154(b) by 453 days.

(21) Appl. No.: 11/214,196

(22) Filed: Aug. 29, 2005

(51) Int. Cl.
*F27B 5/16* (2006.01)
*C21D 1/613* (2006.01)
*C21D 9/663* (2006.01)

(52) U.S. Cl. ..... 266/252; 266/251; 266/253; 266/254; 266/259; 266/266; 432/14; 432/17; 432/77; 432/183; 432/198; 432/199; 432/200; 432/260

(58) Field of Classification Search ..... 266/251–254, 266/259, 266; 432/14, 17, 77, 183, 198–199, 432/200, 260
See application file for complete search history.

(56) References Cited

U.S. PATENT DOCUMENTS 2,504,809 A 4/1950 Dailey, Jr.
3,001,779 A * 9/1961 Williams ..... 431/115
3,980,467 A 9/1976 Camacho et al.
4,287,940 A 9/1981 Corbett, Jr.
4,310,302 A 1/1982 Thekdi et al.
4,445,852 A 5/1984 Corbett
4,516,758 A 5/1985 Coble
4,543,891 A 10/1985 O'Sullivan et al.
4,813,654 A 3/1989 Singler
4,846,675 A 7/1989 Soliman
4,906,182 A * 3/1990 Moller ..... 432/77
5,048,802 A 9/1991 Coble
5,340,091 A 8/1994 Hemsath
5,380,378 A 1/1995 Hemsath
5,388,809 A 2/1995 Hemsath
5,550,858 A 8/1996 Hoetzl et al.
6,063,331 A 5/2000 Iszczukiewicz

* cited by examiner

*Primary Examiner*—Roy King
*Assistant Examiner*—Lois L. Zheng
(74) *Attorney, Agent, or Firm*—Reising, Ethington, Barnes, Kisselle, P.C.

(57) ABSTRACT

A diffuser (24) for an annealing furnace has a plurality of radially extending generally and vertically oriented vanes (40) for radially directing furnace gases. The vanes have top edges (42) defining a generally planar support and the top edges of the vanes have a notch (38) therein for receiving a conduit (34) preferably ring shaped that extend substantially around a center portion of the diffuser plate. The conduit (34) is connected to an inlet (32) for receiving enriching gases and exit ports (50) circumferentially space about said conduit (34) passing the enriching gases into the diffuser (24) to be mixed with ambient furnace gases.

14 Claims, 3 Drawing Sheets

DIFFUSER FOR AN ANNEALING FURNACE

TECHNICAL FIELD

The field of this invention relates to heat treatment apparatus and to improvement in a diffuser with an improved inlet for furnace washing gases.

BACKGROUND OF THE DISCLOSURE

Bell type annealing furnaces have long been used to anneal and spheroidize stacks of coils such as steel strip, wire or rod. The annealing furnace includes an outer cover with a heat source for example gas burners or electrical heating elements that heats the space within outer cover. An inner cover is positioned in the heated space and seals a charge, commonly stacks of metal coil, in a controlled chamber. Ambient initial atmosphere that contains undesirable gases such as oxygen is discharged from the chamber and is continuously replaced with substantially inert furnace gases supplied from an inlet. These furnace gases, commonly referred to as washing gases, for example nitrogen, are ladened with small percentages of hydrocarbons. The gas is used to promote, transfer and circulate heat transferred through the inner cover and provide washing of the stacks of coils as the coils are heated. The hydrocarbons are used to bond to any free oxygen within the furnace in order to prevent the oxygen from attacking the carbon in the annealing metal.

To promote circulation of the furnace gases, a fan is centrally mounted at the base of the furnace. A diffuser plate helps diffuse the furnace gases radially from the central fan radially toward the inner cover of the furnace. Any gases that have been heavily ladened with moisture and other contaminants travel downward and are discharged out through a lower positioned discharge port. Fresh incoming replacement washing gas often referred to as enriching gas is further supplied from the inlet near the bottom of the furnace to be mixed with the previously heated furnace gases. As these gases pass along the inner cover, they are heated up and travel upwards and mix with the previously heated furnace gases.

It has been discovered that the relatively cool enriching gases which have an initial temperature of approximately 100° F. often do not adequately mix and heat up with the previously heated furnace gas which are often at temperatures of approximately 1400° F. If the enriching gases in some cases do not reach a minimum adequate cracking temperature of approximately 900°, concentrated forms of hydrocarbons may be deposited on some coils within the chamber. Furthermore, the cooler gases may prevent some metal coils to reach the desired temperature adequate for proper annealing and spheroidizing. These coils within the annealing furnace may undergo an undesirable phenomenon known as carbon pickup which results in an embrittled metal.

Statistically, most of the above noted problems occur with the coil stacks closest to the enriching gas inlet. The present inlet for the enriching gases is located under the coil stacks. The coil stacks which are round are positioned on the diffuser plate within a round furnace inner cover of substantially larger diameter. If the diffuser plate does not have an upper plate cover, the enriching gases from the inlet can follow an undesirable flow route directly upwardly within the gap that is present between the round inner cover wall and the round coil stacks to prematurely come into contact with the coil stacks located in proximity above the inlet.

What is needed is an improved delivery of furnace enriching gases which will properly be heated and mixed with the previously heated furnace gases to achieve proper mixing, diffusing, and heating before coming into contact with the charge. What is further needed is a diffuser plate which accommodates the improved distribution of enriching gases and provides for the improved diffusion, mixing, and heating of these introduced enriching gases.

SUMMARY OF THE DISCLOSURE

In accordance with one aspect of the invention, an annealing furnace has an inner cover and base. This inner cover and base define an interior control chamber for heating a charge, for example a stack of coils. The interior chamber has an inlet for receiving enriching gases and an outlet for discharging gases. The furnace has a central fan for circulating furnace gases and a diffuser member for radially distributing furnace gases from the fan.

A ring shaped conduit is fluidly connected to the inlet. A plurality of exit ports are circumferentially spaced about the ring shaped conduit for distributing incoming enriching furnace gases from the inlet about the diffuser member.

Preferably, the exit ports have varying sizes and becoming larger farther downstream from the inlet. In one embodiment, the conduit has a circular shape in cross-section and the exit ports are positioned at a radially outer section of the ring shaped conduit and set at an angle between a vertical and horizontal position. The vertical position being defined at the radially outer portion of the ring shaped conduit. For example, the angle can be approximately 45° below the vertical position. It is desirable that the diffuser has a plurality of vanes with a top edge for providing generally planar support for the charge. The top edges have notches therein for nesting the ring shaped conduit therein such that the ring shaped conduit lies wholly below the top edges of the diffuser vanes.

It is desirable that the diffuser member has a sliding connection with the inlet to allow for relative radial movement of the ring member with the inlet as the ring member expands and contracts during heating and cooling cycles of the annealing furnace.

According to another aspect of the invention, a diffuser for an annealing furnace has a plurality of radially extending generally and vertically oriented vanes for radially directing furnace gases. The vanes have top edges defining a generally planar support. The top edges of the vanes have a notch therein for receiving a conduit that extends substantially around a center portion of the diffuser. The conduit has an inlet for receiving enriching gases and exit ports circumferentially spaced about the conduit for passing the enriching gases into the diffuser to be mixed with ambient furnace gases.

Preferably, the conduit is arcuate and may be ring shaped. Also preferably, the conduit has a circular shape in cross-section and the exit ports are positioned at a radially outer section of the ring shaped conduit and set at an angle between a vertical and horizontal position. For example, the angle is approximately 45° below the vertical position. In one embodiment the exit ports have varying size and become larger farther downstream from the inlet.

BRIEF DESCRIPTION OF THE DRAWINGS

Reference now is made to the accompanying drawings in which.

DETAILED DESCRIPTION OF THE PREFERRED EMBODIMENT

Figure 1:
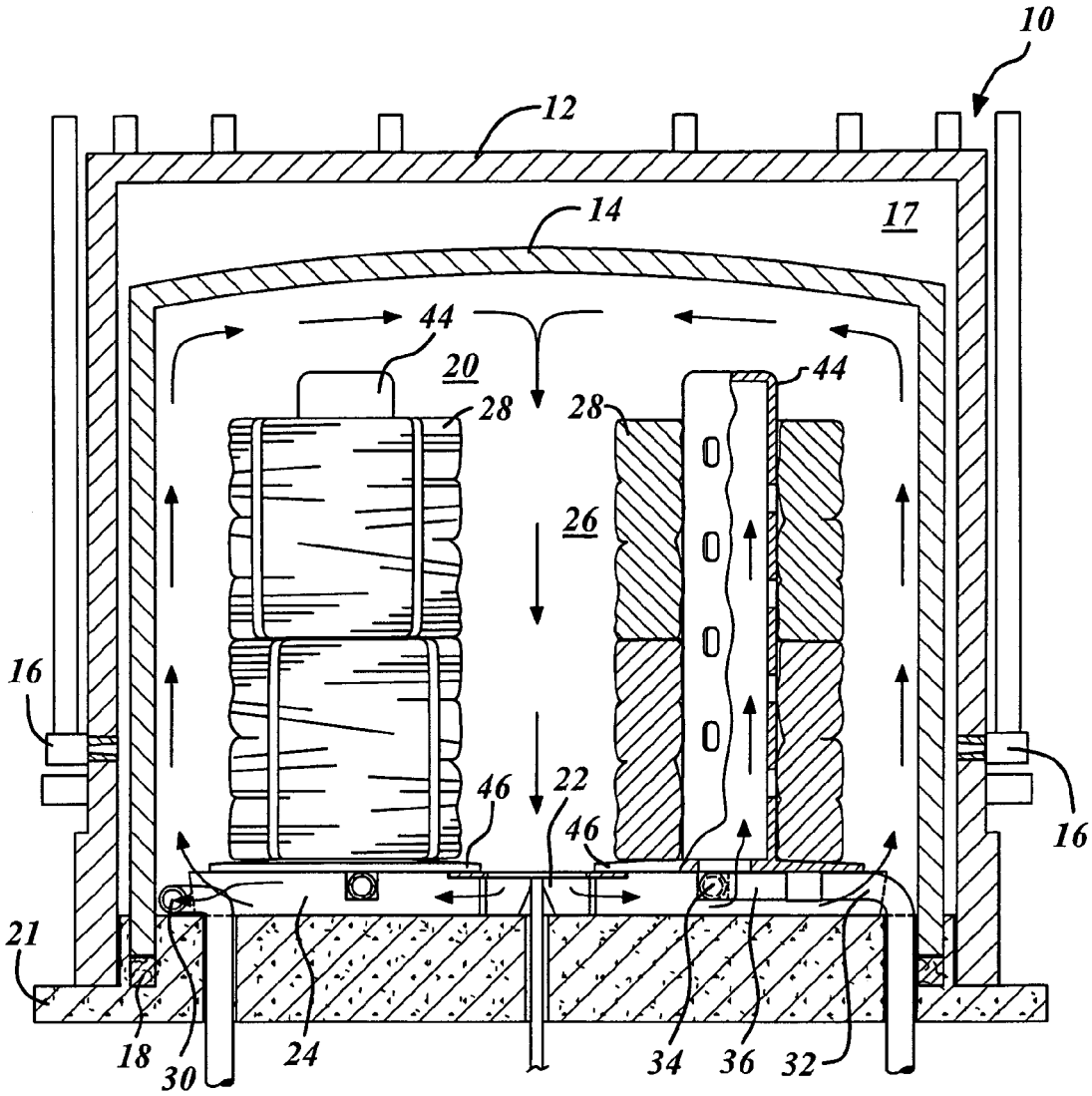
FIG. 1 is an elevational segmented view of an annealing furnace in accordance with one embodiment of the invention.

Referring now to FIG. 1, an annealing furnace 10 has an outer cover 12 and an inner cover 14. Heating sources 16 are installed on the outer cover 12 to provide heat in the space 17 between the inner and outer covers. The heating sources for example may be in the form of gas burners or electrical resistance elements. The inner cover 14 rests on a seal 18 at the floor 21 to seal off the interior chamber 20 within cover 14 from the ambient exterior. While outer cover 12 may have heat insulating properties to retain the heat within, inner cover 14 has heat transferring properties to expeditiously transfer the heat from the space 17 to the interior control chamber 20.

A squirrel cage fan 22 is centrally positioned at the floor 21 of the interior chamber 20 to provide radially outward flow of furnace gases through a diffuser plate 24. The furnace gases are directed radially outwardly through the diffuser plate 24 until they encounter the inner cover 14 where the gases are heated and then rise along the inner cover 14. As the gases approach the top of the interior chamber 20, they are directed then radially inward and then downwardly through an open center channel 26 formed between the stacks of coils 28 that are to be heat treated, e.g. annealing, or spheroidizing.

The initial atmosphere within the chamber 20 present when the chamber is sealed is discharged through discharge port 30 and replaced by a mix of incoming furnace gases, for example, a 94% nitrogen content ladened with a 6% hydrocarbon content in the form of propylene. The furnace gases are provided from inlet 32 at continuous flow rates of approximately 1800 cubic feet per hour.

Figure 2:
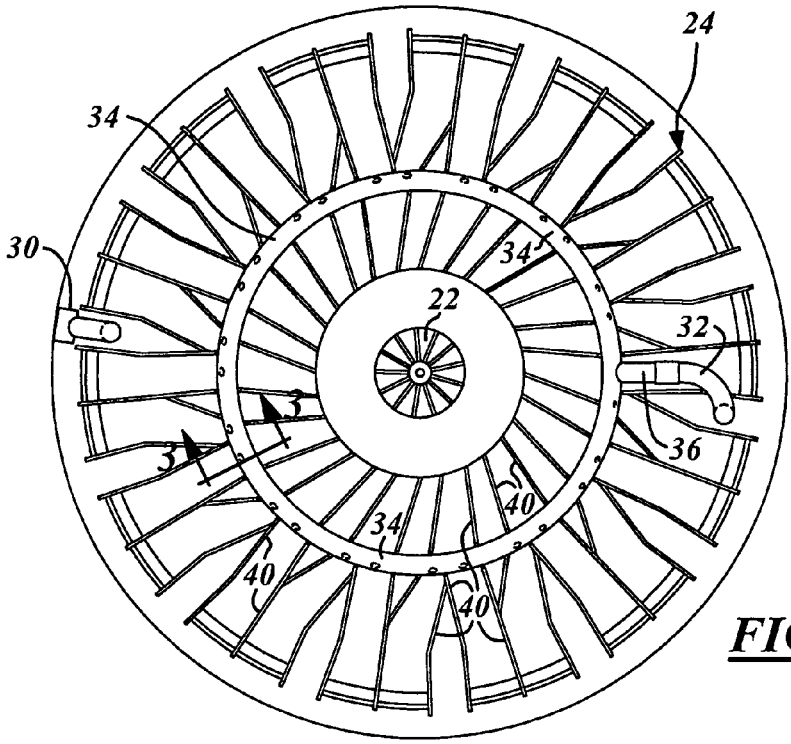
FIG. 2 is plan view of the diffuser plate and ring assembly shown in FIG. 1.
Figure 3:
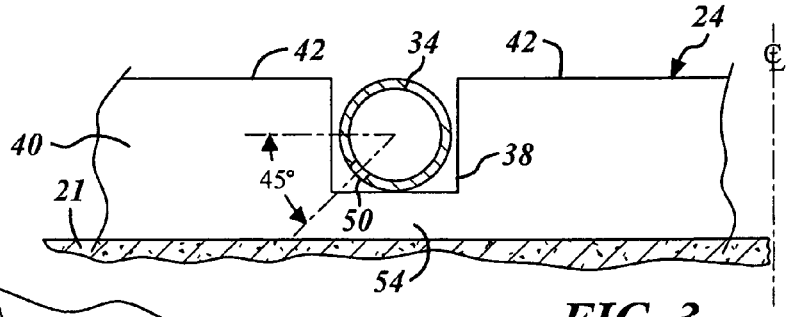
FIG. 3 is an enlarged side elevational view showing the ring shaped conduit nested in the diffuser plate.
Figure 6:
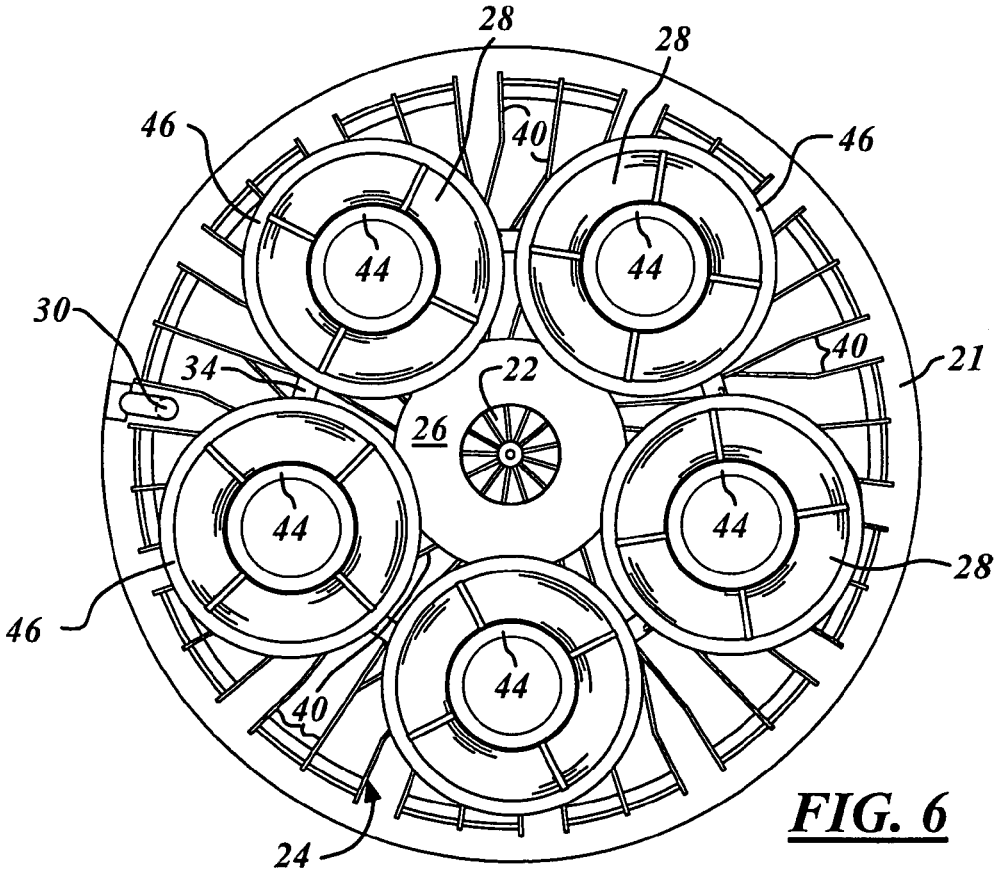
FIG. 6 is a top plan view illustrating the diffuser and ring shaped conduit under a charge of coil stacks.

As shown more clearly in FIGS. 2 and 3, the inlet 32 is connected to a ring shaped conduit 34 through leg 36. The ring shaped conduit 34 is nested in notches 38 cut within the vanes 40 of the diffuser plate 24. The vanes 40 extend generally in a vertical plane and extend radially to direct gas flow from the central fan 22 toward the inner cover 14. The conduit is sized such that that the top portion of the conduit does not extend above the top edges 42 of the vanes 40 and a gap 54 is formed below conduit 34 and floor 21. The top edges 42 are substantially planar and are used as a planar support for the coil stacks 28. The coil stacks 28 as shown in FIGS. 1 and 6 may be mounted about a central spindle 44 that has a lower end plate 46 that functions to hold the coils of metal from falling off the spindle and forms a relatively generally planar surface that can rest on the top edges 42 of the vanes 40.

Figure 4:
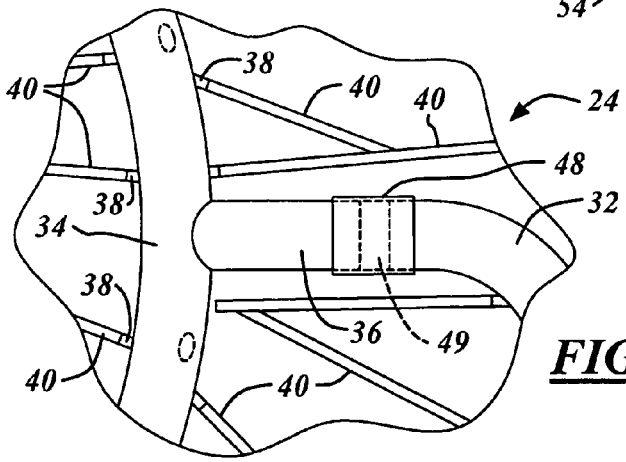
FIG. 4 is a fragmented enlarged top plan view showing the slide connection of the ring shaped conduit member with the inlet member.

As shown in FIG. 4, the incoming leg section 36 has a sliding sleeve connection with inlet 32. This sliding or slip connection may be formed by having the inlet 32 and the incoming leg 36 made from 3 inch pipe both received in opposite ends of a 3½ inch sleeve 48. A gap 49 is provided between the inlet 32 and leg 36 to allow for outward radial expansion of the ring shaped conduit 34 during heating cycles within the furnace.

Figure 5:
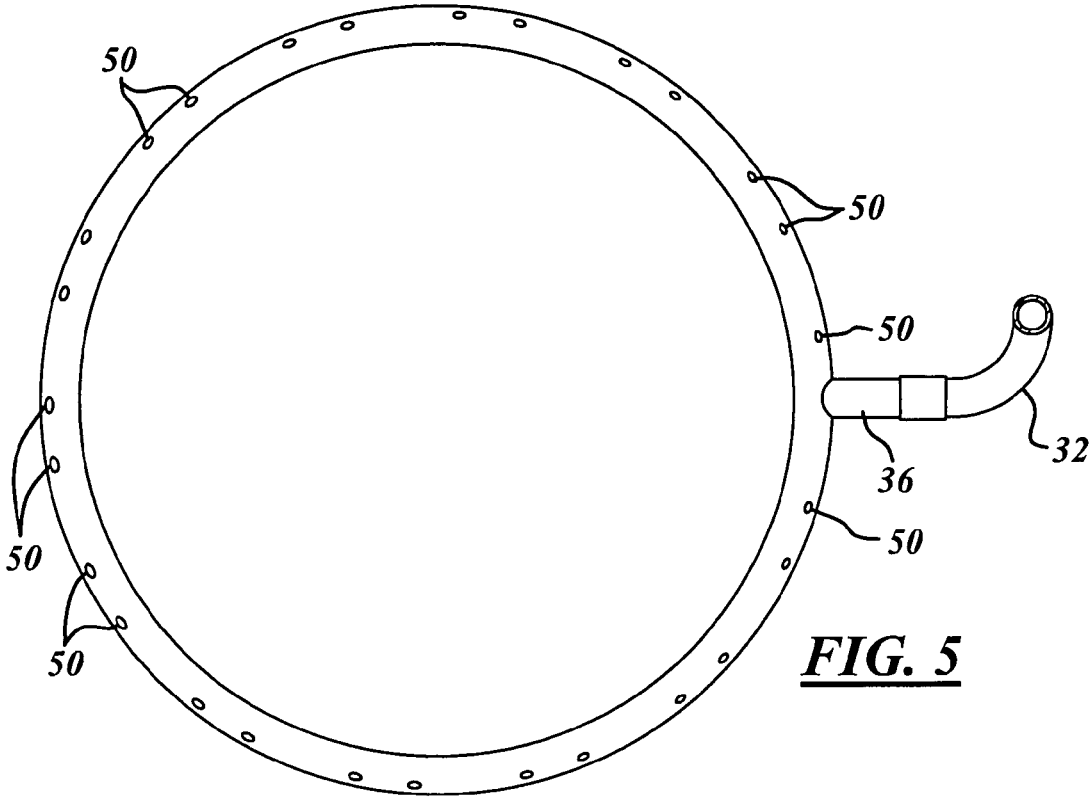
FIG. 5 is a bottom plan view of the ring shaped conduit illustrating the exit ports.

As shown in FIGS. 3 and 5, the ring shaped conduit 34 has a plurality of exit ports 50 circumferentially spaced about the conduit ring. The exit ports 50 have varying sizes, being smaller closer to the inlet 32 and increasing in size as they become farther downstream from the inlet port 32. The sizing should be arranged such that the each exit port 50 provides for the same flow rates of gas therethrough. The exit ports 50 are positioned to be approximately 45° canted down from the radially outer vertical position about the cross section of the ring as clearly shown in FIG. 3.

In operation, when the furnaces in initially closed, furnace gases pass at a rate of about 1800 cubic feet per hour through inlet 32 and then is forced to go through conduit 34 before it enters into the interior chamber 20 to mix with and help displace the initial atmosphere through discharge port 30. The furnace gases, often referred to as washing gases are heated and circulate via the fan 22. The gases are displaced radially outward through the diffuser plate 24 and through the gap 54 provided below ring shaped conduit 34 toward the inner cover 14 where the gases then rise. As the furnace gases approach the top section of the chamber 20, they generally flow radially inward and then downward through central channel 26 to return to the fan and repeat the cycle.

Heavily laden gases with moisture and contaminants sink to the bottom and are discharged through discharge port 30. As enriching gases from inlet 32 continuously flows in. Enriching gases have an initially relatively cool temperature of 100° F. The enriching gases must pass through the leg 36 and the longer conduit ring 34 and is relatively evenly distributed out through all the exit ports 50. Because the leg 36 and ring 34 are within the heated interior chamber 20, the conduit 34 and leg 36 can provide for a significant heat transfer to the enriching gases flowing within. The incoming enriching gas is heated as it travels through the conduit 34 and is further heated and diluted with a larger portion of furnace gases in the diffuser plate as the enriching gases leave the exit ports 50. The enriching gases further mix and heat with the furnace gases as they flow radially outward through the diffuse place until they encounter the inner cover 14. They rise along the inner cover 14. The enriching gases that were initially at a cool approximately 100° F. are now adequately mixed and heated with the existing furnace gases before they encounter contact with the coil stacks 28.

The introduction of the enriching gases through the exit ports 50 is controlled by the sizing of the exit ports 50 about the conduit ring 34 and their canted position about the cross-sectional circumference of the conduit. The 45° angle provides for an exit port 50 which has the gas flow neither encountering a venturi effect from the surrounding flow of the furnace gases nor encounter resistance from back pressure from furnace gas turbulence about the conduit. The minimization of any venturi effect or back pressure allows for a controlled and predictable flow of enriching gas.

Flow of the enriching gases about a full 360° about the diffuser plate 24 under the stacks of coil 28 prevents a concentration of cool enriching gases against the coil stacks and thus prevents carbon pickup on the stacks and also provides for adequate annealing temperatures for all stacks.

In this fashion and improved diffuser plate with a conduit ring substantially reduces of the amounts of carbon pickup and improperly or inadequately annealed and spheroidized coil stacks. A more efficient annealing process with a higher yield and less waste is thus provided.

Variations and modifications are possible without departing from the scope and spirit of the present invention as defined by the appended claims.

The embodiments in which an exclusive property or privilege is claimed are defined as follows:

1. An annealing furnace having an interior control chamber provided by a base and inner cover for heating a charge; said furnace comprising:

a central fan for circulating heated furnace gases;

a diffuser member for radially distributing said heated furnace gases from said fan;

said interior control chamber having an inlet for receiving enriching gases and an outlet for discharging gases; and a ring shaped conduit positioned in said interior control chamber in proximity with said diffuser member and fluidly connected to said inlet forming a separate passage for said enriching gases and with a plurality of exit ports circumferentially spaced about said ring shaped conduit for distributing and introducing said enriching gases into said diffuser member about said ring to initially mix with said heated furnace gases.

2. An annealing furnace as defined in claim 1 further comprising:

said exit ports having varying sizes and becoming larger farther downstream from said inlet.

3. An annealing furnace having an interior control chamber provided by a base and inner cover for heating a charge; said furnace comprising:

a central fan for circulating furnace gases;

a diffuser member for radially distributing furnace gases from said fan;

said interior control chamber having an inlet for receiving enriching gases and an outlet for discharging gases;

a ring shaped conduit fluidly connected to said inlet with a plurality of exit ports circumferentially spaced about said ring shaped conduit for distributing incoming enriching furnace gases about said diffuser member;

said exit ports having varying sizes and becoming larger further downstream from said inlet; and said conduit having a circular shape in cross-section and said exit ports positioned at a radially outer section of said ring shaped conduit and set at an angle between a vertical and horizontal position.

4. An annealing furnace as defined in claim 3 further comprising:

said angle being approximately 45° below the vertical position.

5. An annealing furnace having an interior control chamber provided by a base and inner cover for heating a charge; said furnace comprising:

a central fan for circulating furnace gases;

a diffuser member for radially distributing furnace gases from said fan;

said interior control chamber having an inlet for receiving enriching gases and an outlet for discharging gases;

a ring shaped conduit fluidly connected to said inlet with a plurality of exit ports circumferentially spaced about said ring shaped conduit for distributing incoming enriching furnace gases about said diffuser member; and said conduit having a circular shape in cross-section and said exit ports positioned at a radially outer section of said ring shaped conduit and set at an angle between a vertical and horizontal position.

6. An annealing furnace as defined in claim 5 further comprising:

said angle being approximately 45° below the vertical position.

7. An annealing furnace as defined in claim 5 further comprising:

said exit ports having varying sizes and becoming larger farther downstream from said inlet.

8. An annealing furnace having an interior control chamber provided by a base and inner cover for heating a charge; said furnace comprising:

a central fan for circulating furnace gases;

a diffuser member for radially distributing furnace gases from said fan;

said interior control chamber having an inlet for receiving enriching gases and an outlet for discharging gases;

a ring shaped conduit fluidly connected to said inlet with a plurality of exit ports circumferentially spaced about said ring shaped conduit for distributing incoming enriching furnace gases about said diffuser member;

said diffuser member having a plurality of vanes with a top edge for providing generally planar support; and said top edges having notches therein for nesting said ring shaped conduit therein such that said ring shaped conduit lies wholly below said top edges of said plurality of vanes.

9. An annealing furnace as defined in claim 8 further comprising:

said diffuser member having a sliding connection with said inlet to allow for relative radial movement of said ring shaped conduit with said inlet as said ring shaped conduit expands and contracts during heating and cooling cycles of said annealing furnace.

10. A diffuser for an annealing furnace, said diffuser comprising:

a plurality of radially extending generally and vertically oriented vanes for radially directing furnace gases;

said vanes having top edges defining a generally planar support;

said top edges of said vanes having a notch therein for receiving a conduit that extends substantially around a center portion of said diffuser; and said conduit having an inlet for receiving enriching gases and exit ports circumferentially spaced about said conduit for letting said enriching gases pass into said diffuser to be mixed with said furnace gases.

11. A diffuser as defined claim 10 further comprising:

said exit ports have varying size and become larger farther downstream of said inlet.

12. A diffuser as defined in claim 11 further comprising:

said conduit having an arcuate shape about the center portion of said diffuser; and said conduit having a circular shape in cross-section and said exit ports positioned at a radially outer section of said conduit and set at an angle between a vertical and horizontal position.

13. A diffuser as defined in claim 12 further comprising:

said angle being approximately 45° below the vertical position.

14. An annealing furnace having an interior control chamber provided by a base and inner cover for heating a charge; said furnace comprising:

a central fan for circulating furnace gases;

a diffuser member for radially distributing furnace gases from said fan;

said interior control chamber having an inlet for receiving enriching gases and an outlet for discharging gases;

a ring shaped conduit fluidly connected to said inlet with a plurality of exit ports circumferentially spaced about said ring shaped conduit for distributing incoming enriching furnace gases about said diffuser member; and said diffuser member having a sliding connection with said inlet to allow for relative radial movement of said ring shaped conduit with said inlet as said ring shaped conduit expands and contracts during heating and cooling cycles of said annealing furnace.

* * * * *